US005395285A

United States Patent [19]

Milton

[11] Patent Number: 5,395,285

[45] Date of Patent: Mar. 7, 1995

[54] DEHUMIDIFIER

[75] Inventor: John C. Milton, South Australia, Australia

[73] Assignee: Monarch Industries (Aust) Pty. Ltd., Australia

[21] Appl. No.: 66,135

[22] PCT Filed: Nov. 27, 1991

[86] PCT No.: PCT/AU91/00554

§ 371 Date: May 28, 1993

§ 102(e) Date: May 28, 1993

[87] PCT Pub. No.: WO92/09854

PCT Pub. Date: Jun. 11, 1992

[30] Foreign Application Priority Data

Dec. 3, 1990 [AU] Australia ..... PK3687
Mar. 22, 1991 [AU] Australia ..... PK5220

[51] Int. Cl.[6] ..... B05B 15/12
[52] U.S. Cl. ..... 454/52; 454/53
[58] Field of Search ..... 454/50, 51, 52, 53

[56] References Cited

U.S. PATENT DOCUMENTS

| | | | |
|---|---|---|---|
| 1,748,863 | 2/1930 | Burke . | |
| 2,440,627 | 8/1945 | Bahnson, Jr. . | |
| 2,517,499 | 8/1950 | McGrath | 62/140 |
| 3,395,972 | 8/1968 | Hardison | 454/53 X |
| 4,587,427 | 5/1986 | Beierling et al. | 454/53 X |
| 4,987,952 | 1/1991 | Beal et al. | 165/16 |

FOREIGN PATENT DOCUMENTS

| | | | |
|---|---|---|---|
| 241082 | 11/1962 | Australia . | |
| A34559/89 | 11/1989 | Australia . | |
| B77255/91 | 10/1991 | Australia . | |
| A0244891 | 11/1987 | European Pat. Off. | 454/50 |
| A1563012 | 4/1969 | France . | |
| 2110644 | 9/1972 | Germany | 454/52 |
| A2710254 | 9/1977 | Germany | 454/52 |
| 629686 | 5/1982 | Switzerland | 454/53 |
| 409652 | 8/1932 | United Kingdom . | |
| WO90/06165 | 6/1990 | WIPO . | |
| WO90/07982 | 7/1990 | WIPO . | |

*Primary Examiner*—Harold Joyce
*Attorney, Agent, or Firm*—Eckert Seamans Cherin & Mellott

[57] ABSTRACT

A system to dehumidify a substantially sealed chamber (2) which includes a recirculating duct (1) which recirculates air within the chamber. The duct includes an exchange aperture (3) facing the direction of flow of air (4). A fan (5) to draw air through the duct is positioned downstream of the exchange aperture. A heater (19) is provided preferably within the recirculating duct and preferably located downstream of the display aperture. The sealed chamber (2) may be a spray painting booth for painting vehicles.

12 Claims, 3 Drawing Sheets

DEHUMIDIFIER

BACKGROUND OF THE INVENTION

This invention relates to an apparatus and method of dehumidifying a body of air within a chamber.

A number of processes suffer because the chamber in which these processes are performed has too great a moisture content. Such processes include the spray painting of articles such as vehicles in a spray booth.

Venting the spray booth may be sufficient where the chamber has been used to prewash, for example, a vehicle because the humidity outside the chamber is lower than inside the chamber and therefore the humidity can be reduced to equal that of outside the chamber. However frequently the humidity outside of the chamber is sufficiently high to adversely affect the quality of the finish achieved and it is desirable to further reduce the humidity of air within the spray booth, and simply venting air through the booth does not achieve a sufficient reduction in humidity.

One method of decreasing relative humidity under these circumstances is the provision of a cooling plate wherein a refrigeration unit is used to cool the cooling plate so that moisture condenses out of the air within the chamber, and is then diverted into a collecting tank or a drain. A problem with this means of removing of moisture from the chamber is that the provision of a refrigeration plant is expensive, bulky and is energy consuming to operate.

One object of this invention is to provide an arrangement or a method for reducing relative humidity of a body of air within a chamber in a simple yet effective manner.

A further object of one form of this invention is to provide for a method of spray painting with reduced relative humidity.

SUMMARY OF THE INVENTION

The invention could be said to reside in an arrangement for reducing relative humidity a body of air within a substantially sealed chamber, said sealed chamber including an external recirculating duct positioned to recirculate said body of air through the chamber, a heater means to heat the air either in said duct or said chamber, said duct including an inlet and an outlet with air flow directed from the chamber into the inlet and out of the outlet into the chamber, said duct having an exchange aperture opening to an outside and located between the inlet and outlet and so positioned that a reduction in relative humidity is achieved on heating and recirculating the body of air through the recirculation duct with substantially no ingress of air from outside.

Preferably said exchange aperture faces the direction of air flow in the recirculating duct, the fan means being positioned downstream of the exchange aperture to draw air away from the exchange aperture.

Preferably the direction of airflow approaching the exchange aperture is upwards, and changes direction to leave the exchange aperture lateral to the initial direction.

Preferably the heater means is located within the duct and downstream of said exchange aperture.

It is found in such an arrangement that the relative humidity drops upon heating of the air and upon recirculating of the air through the duct and past the exchange aperture. The drop in humidity within such a chamber with the heating and recirculation of the air is greater than expected simply with the increase in temperature.

An explanation of this phenomenon is not entirely clear however experimentation has shown that the provision of the aperture facing the direction of air flow in the first portion of the duct appears to be crucial to the invention. The provision of a negative pressure in the second portion of the duct so that air is pulled into the second portion appears to have a beneficial effect.

It would seem likely that the air drawn through the first portion of the duct in part mixes with colder air from the environment immediately outside of the aperture, so as to have a condensing effect at the interface therebetween, the condensed moisture being dissipated into the atmosphere from immediately outside of the aperture. The exchange aperture being positioned to face the outside environment enhancing the mixing and condensation effect, whilst the negative pressure in the second portion of the duct ensures that substantially all the air recirculating is not lost to the outside environment.

In an alternative form the invention could be said to reside in a method for reducing humidity of a body of air within a substantially sealed chamber by operation of an arrangement, said arrangement including an external recirculating duct positioned to recirculate said body of air through the chamber, a heater means to heat the air either in said duct or said chamber, said duct including an inlet and an outlet with air flow directed from the chamber into the inlet and out of the outlet into the chamber, said duct having an exchange aperture opening to an outside and located between the inlet and outlet and so positioned that a reduction in humidity is achieved on heating and recirculating the air through the recirculation duct with substantially no ingress of air from outside, said method including the steps of maintaining the exchange aperture in an open position, heating the body of air within the chamber, and recirculating the air from the chamber through the recirculating duct.

A further form of this invention relates to the type of spray booth including heating means as may be used for baking enamel onto sprayed vehicles. The method including a dehumidifying step.

In this further form the invention could be said to reside in a method of spray painting within a sealed chamber in an arrangement, said arrangement including an external recirculating duct positioned to recirculate a body of air through the chamber, a heater means to heat the air either in said duct or said chamber, said duct including an inlet and an outlet with air flow directed from the chamber into the inlet and out of the outlet into the chamber, said duct having an exchange aperture opening to an outside and located between the inlet and outlet and so positioned that on heating and recirculating the air through the recirculation duct with substantially no ingress of air from outside, a reduction in humidity is achieved.

said method including the step of reducing relative humidity of the body of air within the sealed chamber by maintaining the exchange aperture in an open position, heating the body of air within the chamber to a predetermined temperature, and recirculating the air from the chamber through the recirculating duct, and the step of spray painting said vehicle whilst maintaining the body of air at the predetermined temperature, and whilst recirculating the body of air.

A further problem arises in that further humid air is not wanted in the spraying booth during the spray painting, however the provision of adequate venting of the spraying chamber and therefore providing conditions that minimise the harmful effects to the spray painting operator are highly desirable. Venting of the booth can be provided but according to this preferred embodiment of the invention the venting does not include the taking in of air from the atmosphere and in one form is by a recirculation of air from an outlet aperture into a recirculating duct and through a filter means and back into the spraying booth inlet, there being provided fan means to drive air through this recirculating path.

Preferably the arrangement includes a filter within the recirculating duct and between the exchange aperture and the duct outlet to filter out paint vapours.

A sufficient drop in water content for spray painting might be achieved by simply heating the spray booth to very high temperatures, however, temperatures that are higher than about 60° C. also adversely affect the finish achieved with spray painting, the present method gives very satisfactory results with temperatures above ambient but below 60° C., and therefore the method of spray painting according to this invention is preferably done within the above range of temperatures.

BRIEF DESCRIPTION OF THE DRAWINGS

For a better understanding of the invention the following embodiments will now be described with reference to the accompanying drawings wherein, FIG. 1 Is a schematic side view of a first embodiment of the invention showing the layout of the recirculating duct, fan, heater and exchange aperture in relation to the spraying booth.

DESCRIPTION OF THE PREFERRED EMBODIMENTS

Figure 1:
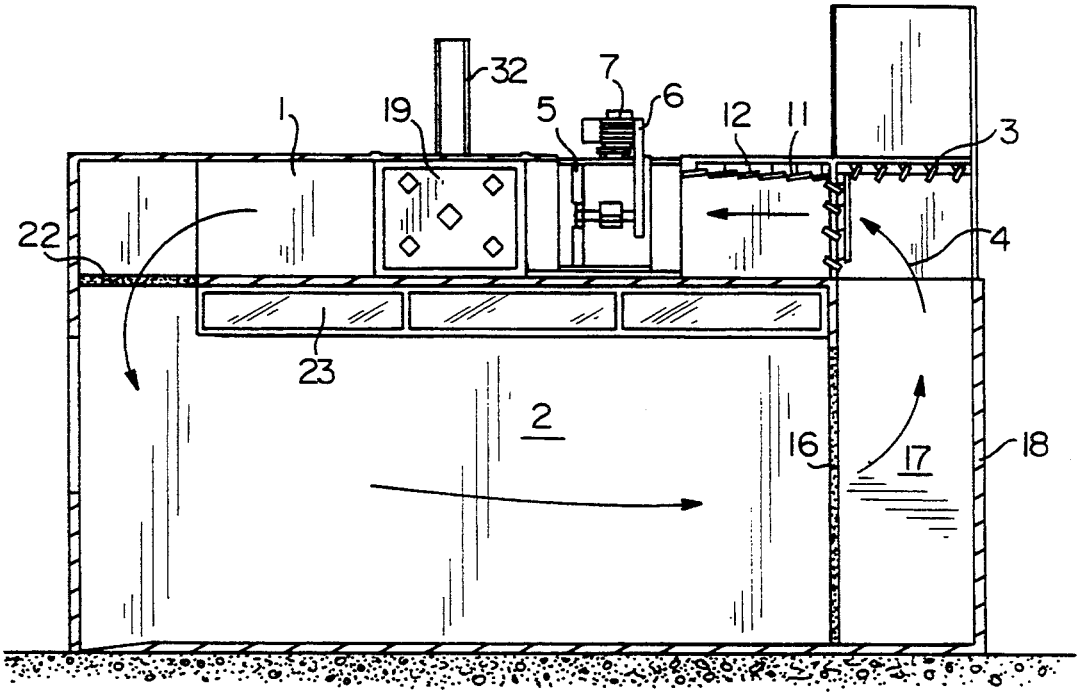
Figure 2:
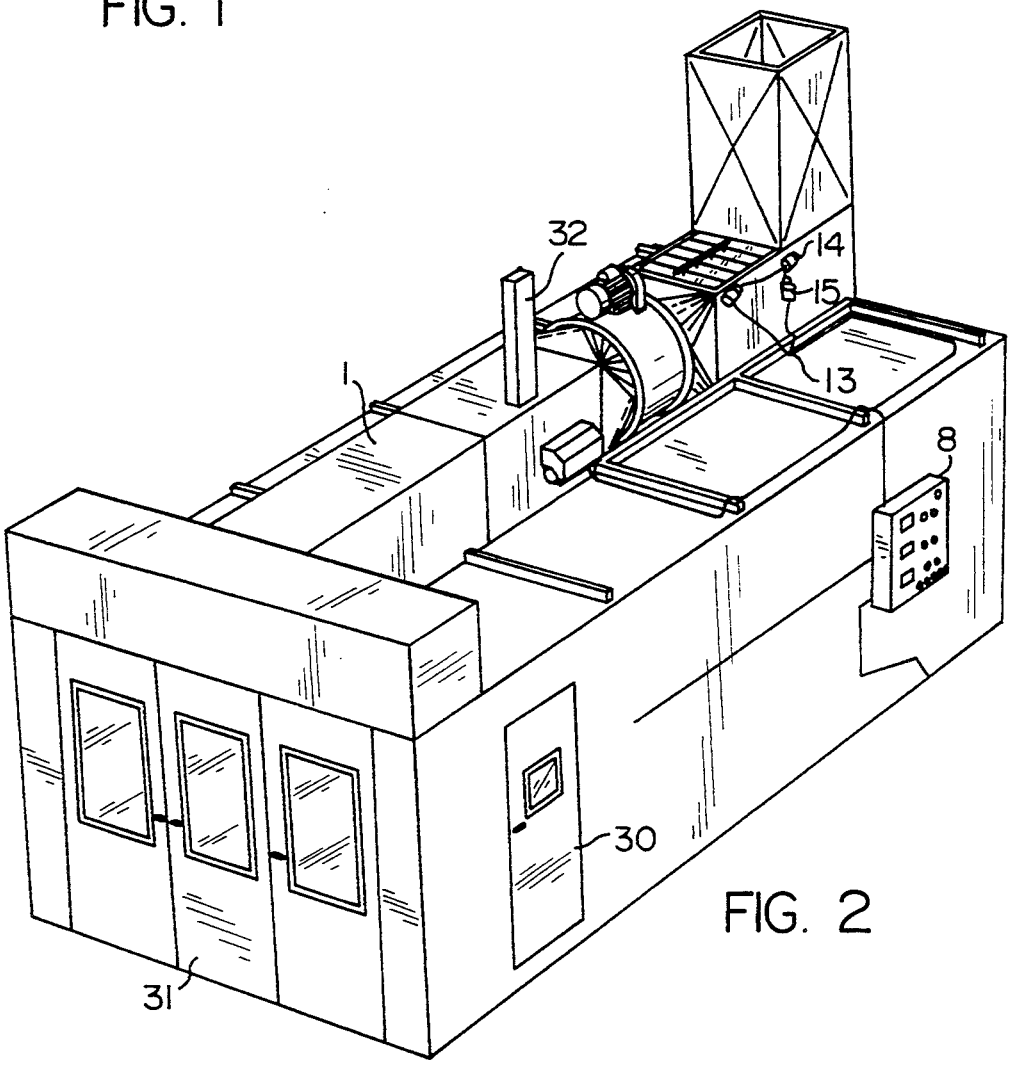
FIG. 2 is a perspective view from the outside of the first embodiment showing the general layout of the spraying booth.
Figure 3:
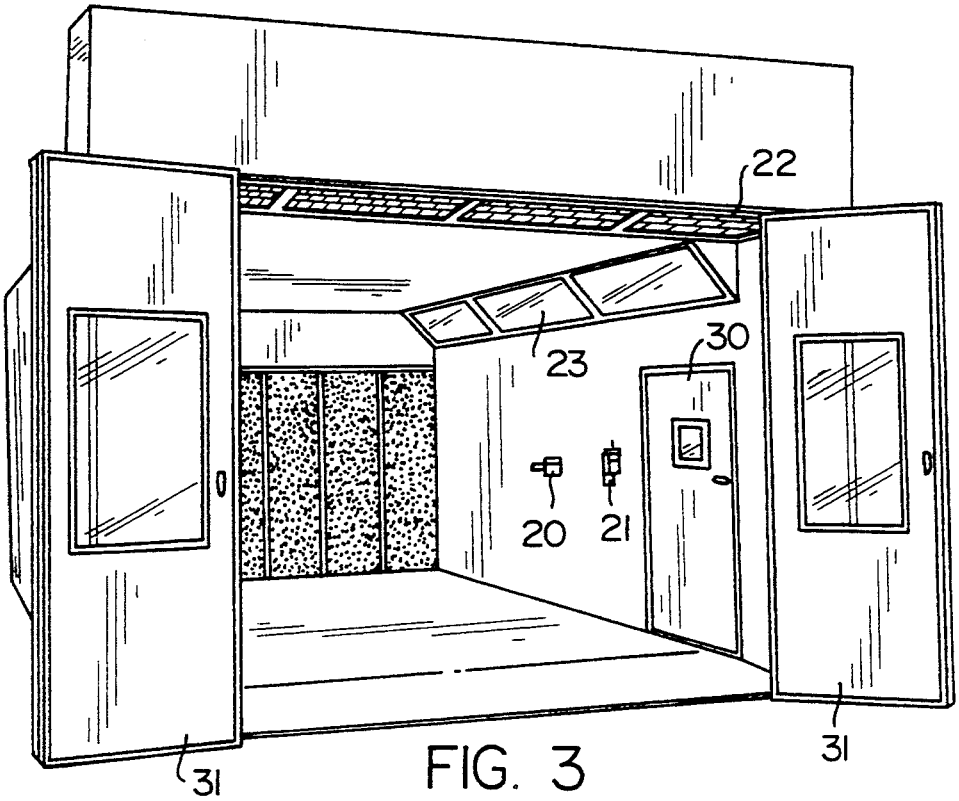
FIG. 3 is a perspective view showing the inside of the first embodiment of the spraying booth, including the arrangement of filters and sensors.
Figure 4:
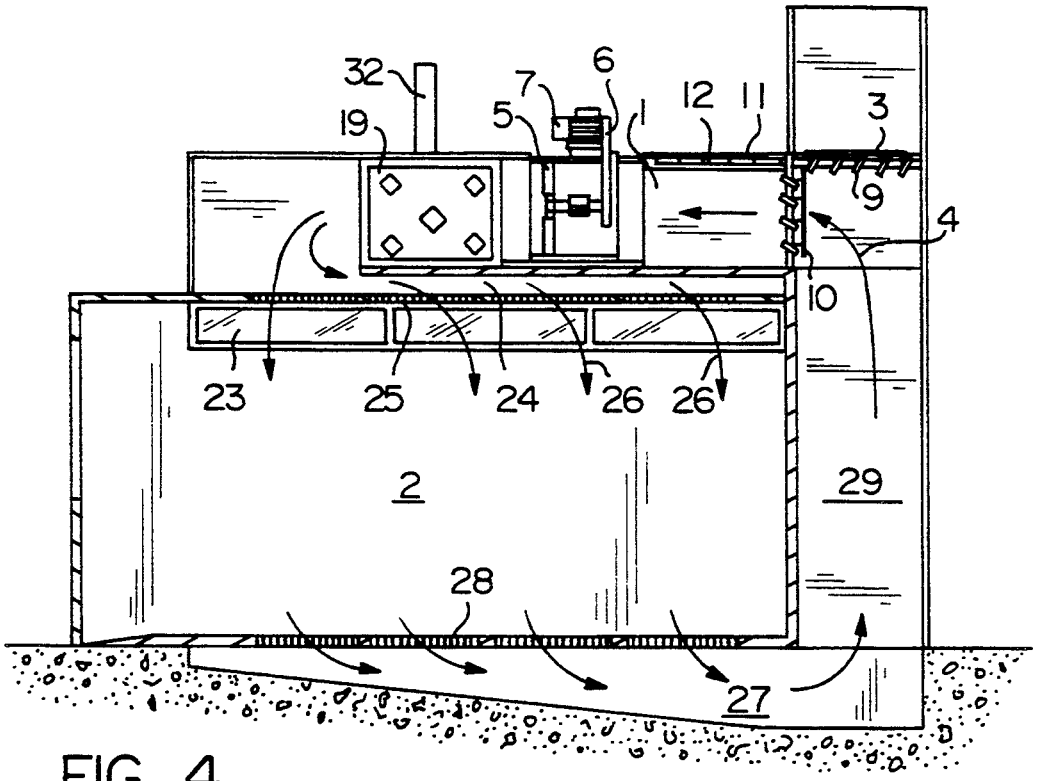
FIG. 4 is a schematic side view of a second embodiment of the invention showing the layout of the recirculating duct, fan, heater and exchange aperture in relation to the spraying booth.
Figure 5:
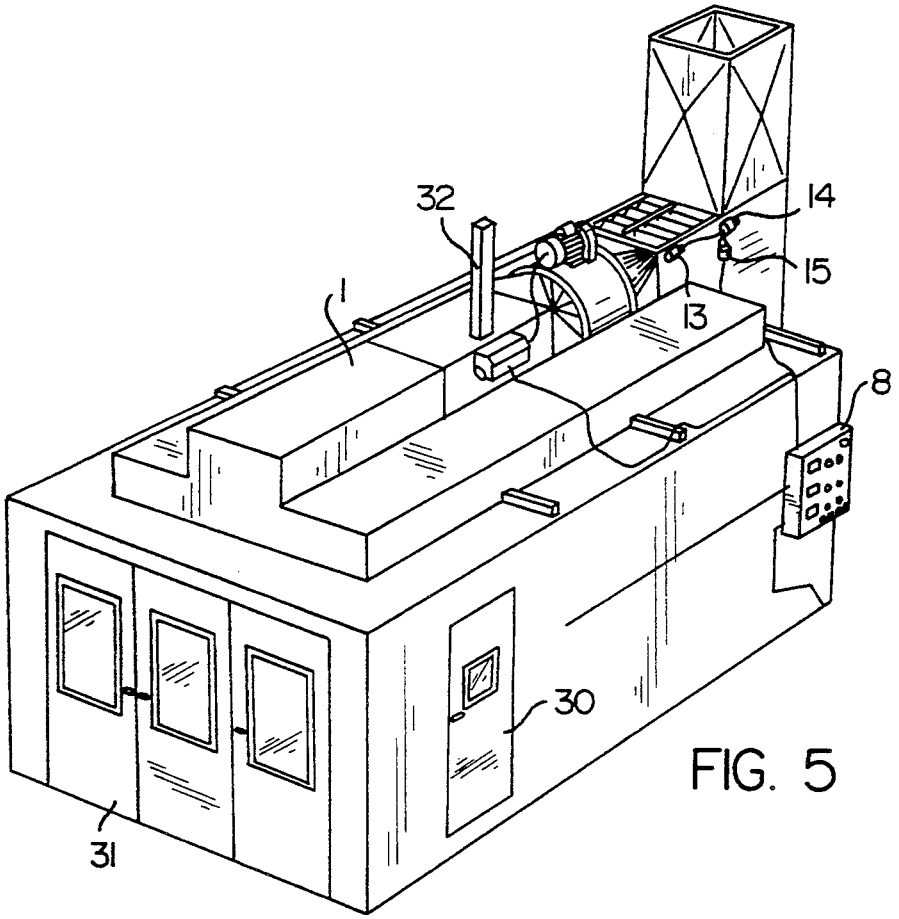
FIG. 5 is a perspective view from the outside of the second embodiment showing the general layout of the spraying booth.
Figure 6:
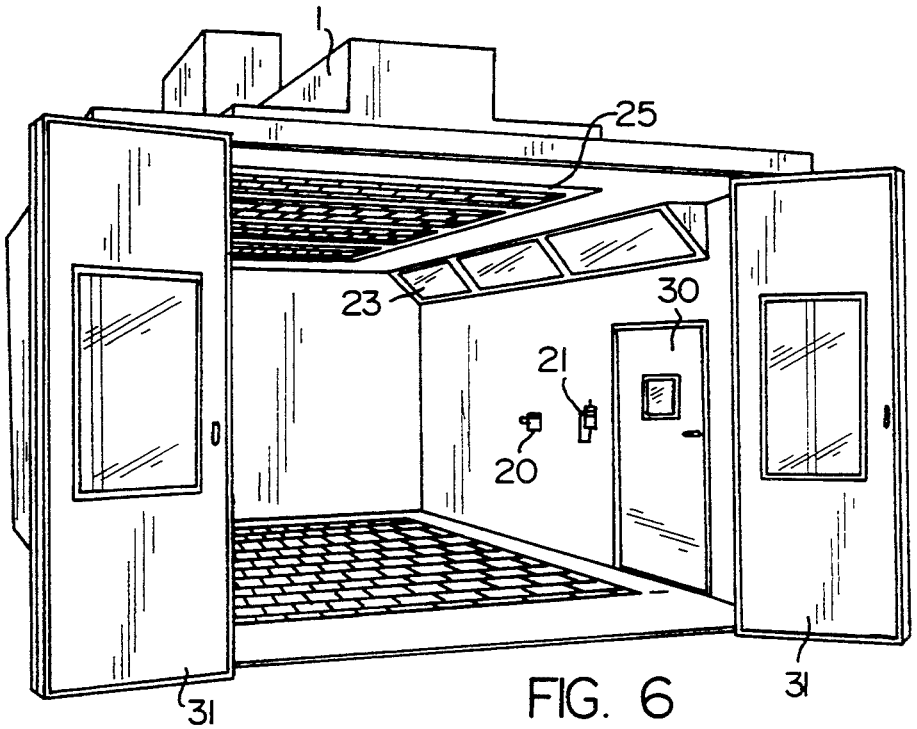
FIG. 6 is a perspective view showing the inside of the second embodiment of the spraying booth.

Similar reference characters indicate corresponding parts throughout the several views of the drawings.

Dimensions of certain of the parts as shown in the drawings may have been modified and/or exaggerated for the purposes of clarity of illustration.

The embodiments shown are spray booths, each having a duct 1, fitted to a chamber 2 which is substantially sealed. The chamber is not necessarily completely air tight and some exchange may occur between the inside and outside of the chamber (apart from through the exchange aperture) and this will diminish the effectiveness of the system but will still function to reduce the humidity provided that the chamber is largely sealed off and no major airflow occurs.

The duct 1 communicates between one portion of the chamber and an opposite portion of the chamber so that flow of air is created in the chamber and substantially all the air within the chamber is moved either from end to end as in the first embodiment, or top to bottom as in the second embodiment.

An exchange aperture 3 is positioned within the duct and faces the oncoming flow of air shown by arrow 4. A fan 5 is positioned within the duct and just downstream of the exchange aperture. This positioning of the fan provides for a suction within the duct drawing air away from the exchange aperture and pushing air through the remainder of the duct and the air chamber.

The fan is driven by a fan belt 6 coupled to an electric motor 7 that can be actuated from a switch on the control panel 8.

A set of louvres to control air flow are positioned at the beginning portion of the duct 1, a first louvre 9 controls flow through the exchange aperture 3, a second louvre 10 controls flow through the duct and a third louvre 11 controls flow through an inlet 12. All three sets of louvres are operable by separate electric motors 13, 14, and 15, that can be actuated from the control panel. In the dehumidification cycle, louvre 9 is kept open as is louvre 10, whereas louvre 11 is shut.

In the first embodiment the body of air within the chamber is moved from one end of the chamber to the other. A filter 16 is provided across the closed end of the chamber, forming a plenum chamber 17 between the filter and the end wall 18. Air is drawn towards the exchange aperture up by the fan 5, and is drawn into the recirculation duct.

A heat exchanger 19 is provided in the duct downstream of the fan 5. The heat exchanger can of course be of any type suitable for the purpose but in this embodiment takes the form of a series of heated tubes passing laterally across the duct, and in communication with two upright side plates on opposite sides of the duct and in communication with a flue 32.

A temperature sensor 20 is provided within the sealed chamber, and is connected with a thermostat to control the operation of the heater so that a given temperature can maintained.

Similarly a sensor measuring relative humidity 21 is also provided, and connected with a display on the control panel.

A filter is provided at the outlet 22 of the duct, so that air when recirculated is passed through two filters before re-entering the spray booth.

The walls of the sealed chamber are insulated, so that the temperature inside the booth can be kept relatively even, and so that the energy input required to maintain an elevated temperature is kept to a minimum.

A bank of lights 23 is provided on the inside of both side of the chamber.

In the second embodiment a down draught is provided in a spray booth, an outlet chamber 24 is positioned over the chamber 2, and air enters the chamber through a filter 25 extending over substantially all the area of the ceiling of the spraybooth as shown by arrows 26. The floor of chamber 2 has a broad well 27 beneath it, spanning a substantial portion of the width of the floor. A mesh 28 of expanded metal is supported on a frame to allow for airflow therethrough whilst providing for support of a vehicle. A vertical portion of 29 the duct extends upwardly from the well 27 towards the exchange aperture 3. The duct 1 thus has two parts, a vertical portion extending up one end of the chamber 2 and a horizontal portion extending across the top of the chamber, the horizontal portion of the duct being arranged in much the same way as the second embodiment.

The two embodiments shown have a heater in the duct, however the heater means can be provided separately and potentially within the chamber. Preferably however the means for heating is positioned within the duct 1 or in another position that has a greater airflow than the remainder of the chamber 2 to give effective disperson of the heat.

For the purposes of re-spraying, vehicles are first prepared and this includes a washing step. This washing step results in considerable excess moisture, with a resultant increased water content. In a humid environment such moisture is difficult to otherwise dispel and can result in a substandard finish on the vehicle to be painted.

The spray booths of both embodiments has a personal access door 30 provided at one side of the booth, for access by an individual. At an open end the booth is provided with a vehicle access door 31, that can be opened up so that a vehicle can be driven into the spray booth, and provides for closure after the vehicle is positioned inside.

In use then, the vehicle is washed and is entered into the chamber through vehicle access doors 31. Louvres 9 and 10 are left open, and louvre 11 is closed, so that air is recirculated through duct. Fan 5 sucks air into the duct 1 and pushes air into the air chamber through filter in the outlet 22 or 25. The heater increases the temperature within the chamber and the duct. Initially it might be desired to keep the inlet louvre 11 open together with the duct louvre 10 closed so that a greater exchange of air from the inside is made with air outside of the duct and the chamber before the heater is switched on.

Once the relative humidity has reached a desired level, the outlet louvres 9 can be closed, and the temperature can be dropped back, if the temperature during the dehumidification step is too high for spray painting.

For the purposes of re-spraying of vehicles a dehumidification has been observed with an ambient temperature of approximately 25° C. the temperature within the chamber being raised to 45° C. A higher temperature within the air chamber increases the rate of dehumidification and thus a temperature of 60° C. can be used, however the difficulty is that the temperature must not be raised too much because the vehicle may be heated to an extent where such elevated temperatures have an adverse effect on the finish of the painted vehicle. Where the operating temperature of this system for dehumidification is 60° C. a temperature drop is found necessary before painting is commenced. This can be effected simply by switching off the heating means and recirculating the air in the same way as in the dehumidification step.

It is found that on initiating the dehumidification step, the humidity initially increases, and this is in part thought to be due to moisture being released from the filters used in the spray booth and duct. The relative humidity drop as the temperature increases might be expected from the natural decrease in humidity for the same water content with increased temperature. The decrease in relative humidity continues to decrease after the temperature has reached the desired temperature. The final relative humidity reading for air within the chamber is found to drop well below that expected by reason of merely a temperature increase.

By way of example the the relative humidity within the chamber at an initial temperature of 22° C. was approximately 40. The temperature of the air chamber was raised to 50° C. and the final humidity reading was approximately 5. Clearly the relative humidity of the body of air within the chamber has been reduced.

One possible explanation as to why moisture exchange occurs so effectively is that the stream of air derived from the duct despite the abrupt change has a laminar flow, and that the particular arrangement increases the area of contact between the two sources of air so as to increase the potential for condensation and removal of moisture.

After the spraying step, the temperature can be elevated for baking.

Whilst embodiments shown are related particularly to spray painting, the invention is adapted to be used in a chamber that requires low relative humidity for other purposes other than spray painting.

I claim:

1. An arrangement for reducing relative humidity of a body of air in a substantially chamber, said chamber when substantially sealed including an external recirculating duct positioned to recirculate said body of air through the chamber, heater means for heating said body of air in one of said duct and said chamber relative to outside air outside the chamber, said duct including an inlet and an outlet with an airflow of said body of air directed from the chamber into the inlet through said duct and out of the outlet into the chamber, said duct having a single exchange aperture only, located between the inlet and outlet, said airflow at a location in said duct upstream from the exchange aperture being directed towards a face of the exchange aperture, said body of air being exposed to the outside air at the exchange aperture, the duct and the exchange aperture being structured to preclude a substantial ingress of the outside air at said exchange aperture and to exchange moisture between said body of air flowing through the duct and the outside air without said ingress of the outside air, and further comprising fan means positioned within the duct between the exchange aperture and the outlet so that said body of air is adapted to be drawn from the chamber through the inlet of the duct, past the exchange aperture and through the outlet to the chamber.

2. An arrangement as in claim 1 including a means reducing air flow in said duct immediately downstream of the exchange aperture.

3. An arrangement as in claim 1 wherein the heater means is located within the duct and downstream of said exchange aperture.

4. An arrangement as in claim 1 wherein a direction of air flow approaching the exchange aperture is upwards, and a direction of the air flow leaving the exchange aperture is lateral to the direction of air flow approaching the exchange aperture.

5. An arrangement as in claim 1 wherein the exchange aperture has generally the same cross-sectional dimensions as the recirculating duct.

6. A method for reducing relative humidity of a body of air within a substantially sealed chamber that includes an external recirculating duct, comprising the steps of:

recirculating an airflow of said body of air through said duct and through said chamber, said duct including an inlet and an outlet with said airflow directed from said chamber into said inlet and out of said outlet into said chamber, and a single exchange aperture only, opening to outside air outside said chamber, said exchange aperture located between said inlet and said outlet;

heating said body of air relative to outside air using heater means in one of said duct and said chamber;

directing said airflow, at a location in, aid duct upstream of said exchange aperture, towards a face of said exchange aperture;

passing the body of air over said exchange aperture via fan means positioned within said duct and between said exchange aperture and said outlet for recirculating said body of air through said inlet of said duct, past said exchange aperture and through said outlet to said chamber;

substantially precluding ingress of the outside air through the exchange aperture while exposing the body of air to the outside air at the exchange aperture, and while allowing exchange of moisture between air flowing through said duct and air outside of said duct; and maintaining said exchange aperture in an open position, while heating said body of air within said chamber and recirculating said body of air with said fan means.

7. A method of reducing relative humidity within a substantially sealed chamber as defined claim 6 comprising directing the airflow such that a direction of airflow approaching the exchange aperture is upwards, and a direction of the airflow leaving the exchange aperature is lateral to the direction of airflow approaching the exchange aperture.

8. A method of reducing relative humidity as in claim 6 further comprising filtering the body of air using a filter within said recirculating duct downstream of said exchange aperture and at or before said outlet; to filter out paint vapors.

9. A method of reducing relative humidity as in claim 6 comprising heating the body of air to a temperature of at least about 45° C. and below 60° C.

10. A method as in claim 6 comprising forming said exchange aperture to cross-sectional dimensions generally equal to that of said recirculating duct.

11. A method of spray painting an item within a substantially sealed chamber coupled to an external recirculating duct positioned to recirculate a body of air through said chamber, with heater means in one of said duct and said chamber for heating said body of air in one of said duct and said chamber to a temperature higher than outside air outside said duct and Said chamber, said duct including an inlet and an outlet with an airflow directed from said chamber into said inlet and out of said outlet into said chamber, and fan means in said duct for recirculating said body of air from said chamber through said duct, the method including the steps of:

providing a single exchange aperture only in said duct upstream from the fan means, the exchange aperture opening to the outside air and located between said inlet and said outlet;

directing the airflow, at a location in the duct upstream of the exchange aperture, towards a face of the exchange aperture;

exposing said body of air to the outside air at the exchange aperture while substantially preventing ingress of outside air, and thereby reducing relative humidity of said body of air within said chamber by exchange of moisture to the outside air through the exchange aperture;

maintaining said exchange aperture in an open position while heating said body of air with said heater means to a predetermined temperature, and recirculating said body of air with substantially no ingress of the outside air from said outside into said chamber through said exchange aperture; and spray painting said item in said chamber while maintaining said body of air at said predetermined temperature and while recirculating said body of air.

12. A method of spray painting an item within a substantially sealed chamber as defined in claim 11 comprising directing the airflow to maintain said local direction of airflow upstream of said exchange aperture in an upward direction and maintaining a direction of airflow leaving said exchange aperture in a direction lateral to said local direction of airflow upstream of said exchange aperture.

* * * * *

UNITED STATES PATENT AND TRADEMARK OFFICE

CERTIFICATE OF CORRECTION

PATENT NO. : 5,395,285
DATED : March 7, 1995
INVENTOR(S) : John C. Milton

It is certified that error appears in the above-indentified patent and that said Letters Patent is hereby corrected as shown below:

Column 6:

Claim 1, line 8, after the word "substantially", insert

— sealable —.

Claim 11, line 10, delete the word "Said" and insert therefor

— said —.

Signed and Sealed this

Twentieth Day of June, 1995

*Attest:*

BRUCE LEHMAN

*Attesting Officer*

*Commissioner of Patents and Trademarks*